US006053281A

United States Patent [19]

Murray

[11] Patent Number: 6,053,281

[45] Date of Patent: Apr. 25, 2000

[54] ROOF PERIMETER SAFETY RAIL SYSTEM

[75] Inventor: Jeffery L. Murray, West Seneca, N.Y.

[73] Assignee: Murray Roofing Company Inc., Cheektowaga, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/998,566

[22] Filed: Dec. 29, 1997

[51] Int. Cl.[7] ..... E04G 5/00

[52] U.S. Cl. ..... 182/113; 182/45; 256/59; 256/65; 256/DIG. 6; 248/237

[58] Field of Search ..... 182/45, 113; 256/40, 256/59, 65; 248/237

[56] References Cited

U.S. PATENT DOCUMENTS

| | | | |
|---|---|---|---|
| 263,348 | 8/1882 | Meng | 256/40 |
| 718,602 | 1/1903 | Chase | 182/45 |
| 735,026 | 7/1903 | Willmarth et al. | 256/40 |
| 859,241 | 7/1907 | Nantel | 182/45 |
| 3,237,922 | 3/1966 | Koinzan | 256/40 |
| 3,584,839 | 6/1971 | Dickey | 256/59 |
| 3,853,203 | 12/1974 | Werner et al. | 182/113 |
| 3,863,900 | 2/1975 | Dagiel et al. | 256/59 |
| 3,880,405 | 4/1975 | Brueske | 256/59 |
| 3,901,481 | 8/1975 | Probst | 256/59 |
| 3,995,833 | 12/1976 | McLaughlin | 256/59 |
| 4,037,824 | 7/1977 | Whitmer | 182/113 X |
| 4,620,612 | 11/1986 | Enoki et al. | 182/113 |
| 4,666,131 | 5/1987 | Kettelkamp, Sr. et al. | 256/59 |
| 4,830,341 | 5/1989 | Arteau et al. | 256/59 X |
| 4,909,483 | 3/1990 | Van Herpen | 256/59 |
| 4,979,725 | 12/1990 | Hutchings et al. | 256/64 |
| 5,029,670 | 7/1991 | Whitmer | 182/113 |
| 5,060,754 | 10/1991 | Feick | 182/113 X |
| 5,221,076 | 6/1993 | Zust | 256/31 |
| 5,318,148 | 6/1994 | Franco et al. | 182/45 |
| 5,558,312 | 9/1996 | Brennan | 256/65 |
| 5,607,029 | 3/1997 | Beckham | 182/113 X |
| 5,647,451 | 7/1997 | Reichel | 256/DIG. 6 X |
| 5,649,690 | 7/1997 | Kilmer | 256/40 X |
| 5,711,398 | 1/1998 | Bartholomew | 256/DIG. 6 X |
| 5,896,944 | 4/1999 | McMillian et al. | 182/45 |

FOREIGN PATENT DOCUMENTS

| | | | |
|---|---|---|---|
| 3719403 | 12/1987 | Germany | 182/45 |

OTHER PUBLICATIONS

Protective Roofing Products Ltd.—PR–100 Safety Rail—at least as early as Dec. 10, 1997.

*Primary Examiner*—Daniel P. Stodola
*Assistant Examiner*—Bruce A. Lev
*Attorney, Agent, or Firm*—Simpson, Simpson & Snyder, L.L.P.

[57] ABSTRACT

A safety rail system for installation about the perimeter of a rooftop work site comprises a plurality of stanchion-supporting bases for attachment to existing building structure, a plurality of stanchions removably held by the bases and having cable-receiving links thereon, and a pair of wire rope cable safety rails supplied by a pair of winches fixed to at least one of the stanchions. The bases include a pair of plate members connected by a hinge for adjustable attachment to a vertical wall surface of the building and another structural surface forming an edge with the vertical wall surface. A vertically extending sleeve is fixed to the plate member which attaches to the vertical wall surface of the building for slidably receiving a bottom portion of a stanchion, and a transversely extending locking pin is used to retain the bottom portion of the stanchion within the sleeve. The safety rail cables are unwound from their respective winches and connected to the stanchions using the cable receiving links, then tensioned using the winches.

5 Claims, 4 Drawing Sheets

FIG. 7
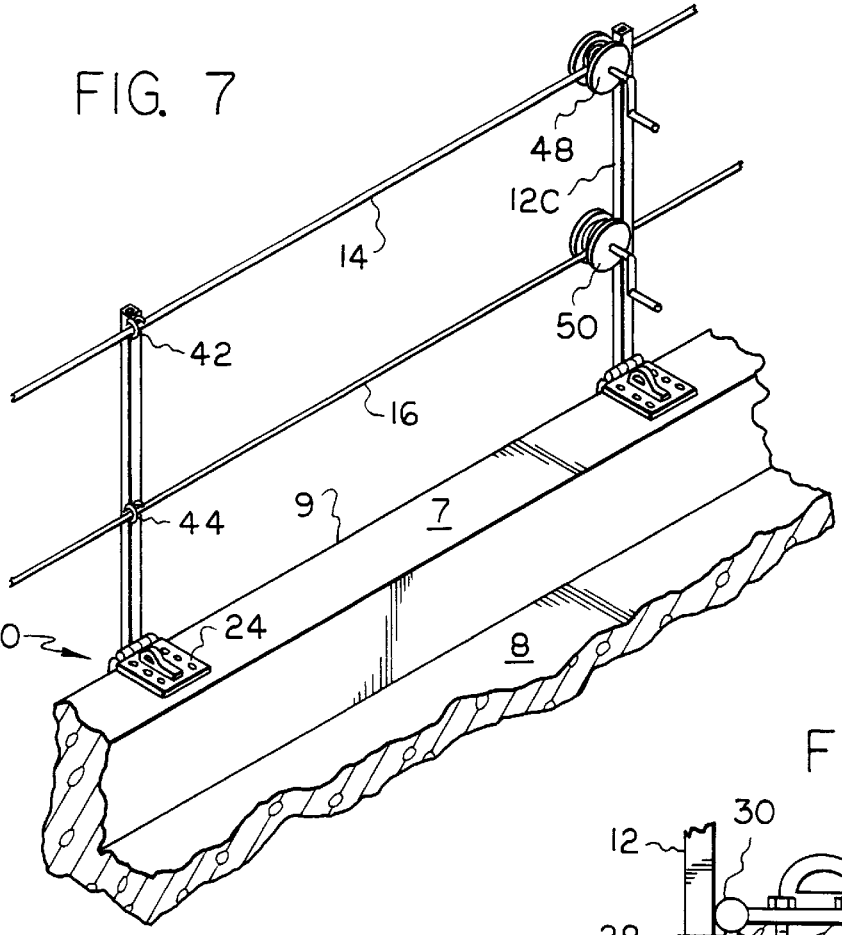
FIG. 8
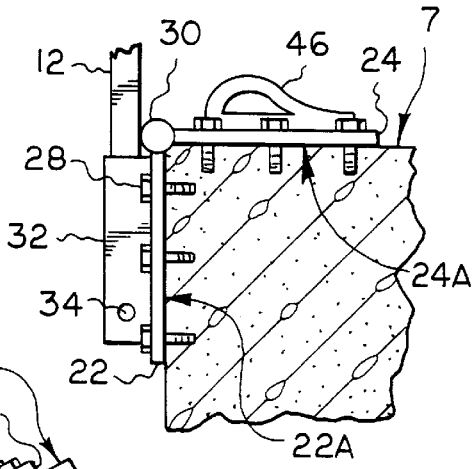
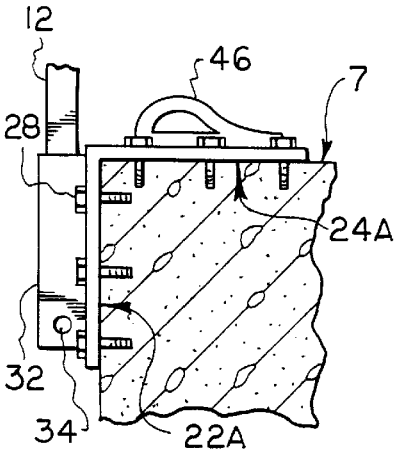
FIG. 10
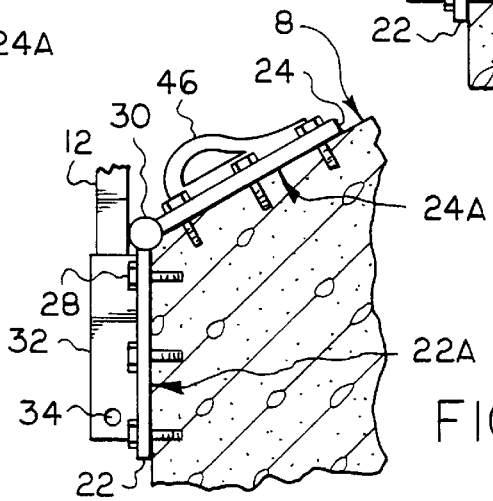
FIG. 9

ROOF PERIMETER SAFETY RAIL SYSTEM

BACKGROUND

A. Field of the Invention

The present invention relates generally to the field of fall prevention apparatus for rooftop workers, and more particularly to an improved safety rail system for installation about the perimeter of a roof.

B. Description of the Prior Art

During application and maintenance of roofing on buildings, workers are placed at risk of falling from heights which are known to cause serious injury or death. Therefore, insurance companies and governmental agencies such as OSHA now prescribe that a safety barrier be erected about the perimeter of a rooftop work site to prevent accidental falls.

In view of this need, several safety rail systems designed to be erected about a roof perimeter have been proposed. U.S. Pat. No. 3,584,839 to Dickey discloses a system wherein an upright post or stanchion includes a horizontal arm extending inwardly from a bottom portion thereof, and the arm is provided with a downwardly directed spike at its distal end which is sized to fit within a sleeve embedded in poured concrete of the roof. The stanchion includes a pair of spaced apart clamp members for securing overlapping wooden rails to the stanchion.

U.S. Pat. No. 3,880,405 to Brueske teaches a another perimeter safety rail system designed primarily for use on roof construction having a plurality of ribbed roof panels. The system of Brueske includes posts or stanchions which are fixed directly to a base having one of several disclosed attachment means, depending upon where the base and stanchion are to be mounted. Diagonal braces are provided for further supporting the stanchions. This patent shows the use of straps having clips at their opposite ends for connection to a pair of spaced stanchions.

An adjustable roof perimeter guard rail system is shown in U.S. Pat. No. 3,901,481 to Probst. In this system, a base plate is fastened to the roof by nails or other fasteners, and an internally splined bushing is welded to an outer edge of the base plate to extend horizontally with the roof edge. An externally splined shaft is removably mated within the bushing and carries a sleeve fixed to extend tangentially from the shaft, whereby the vertical attitude of the sleeve may be adjusted at discrete angular increments as dictated by the splined fitting. Stanchions or posts are slidably received by the sleeves and include means for supporting a pair of horizontal rails.

An adjustable guard rail stanchion apparatus is disclosed in U.S. Pat. No. 4,666,131 to Kettelkamp, Sr. et al. The apparatus includes an L-shaped stanchion member having pivotally adjustable clamping means at the base of the L for attaching the apparatus to an existing rafter board.

U.S. Pat. No. 4,979,725 to Hutchings, II et al teaches a triangular safety rail support comprising a base leg for attachment to a roof, a diagonal brace, and a telescopically adjustable two-part stanchion having upper and lower stanchion members. The lower stanchion member and the diagonal brace are pivotally connected to the base leg at opposite ends thereof, and a remaining end of the diagonal brace is pivotally connected to the upper stanchion member, thus providing adjustability for accommodating different roof pitches. The stanchion includes means for holding boards serving as horizontal rails.

Another protective system is disclosed in U.S. Pat. No. 5,221,076 to Zust, wherein the base of each stanchion is clamped within an existing gutter, and stanchion support lines are anchored to the roof.

U.S. Pat. No. 5,558,312 discloses an adjustable safety bracket for use in erecting a roof perimeter barricade. An attachment member of the bracket includes a channeled portion for engaging a free end of a roof joist, and a yoked portion extending from the joist for pivotally connecting a support member thereto. The support member is adapted to hold a wooden post for supporting the barricade.

Finally, applicant is aware of a safety rail system marketed by Protective Roofing Products Ltd of Stoney Creek, Ontario, Canada. The system utilizes wedge anchors fixed to a structural wall, and wall clamps, for securing stanchions about the roof perimeter. The stanchions include spaced apart clamping means for securing rail boards to the stanchions.

Shortcomings of the prior art systems mentioned above include labor-intensive and time-consuming installation and removal procedures; bulky rails which may be placed on the rooftop when a section of the guard rail is opened to permit transport of materials, equipment, and workers to the roof, thereby presenting a risk that a worker may trip over a carelessly placed rail; and extensive space requirements for storage and transport.

SUMMARY OF THE INVENTION

Therefore, it is an object of the present invention to provide a roof perimeter safety rail system which is easy and fast to install, and which may be installed by a single worker, if necessary.

It is another object of the present invention to provide a roof perimeter safety rail system which disassembles for compact storage and transport, and which does not utilize bulky rail members.

In furtherance of these and other objects, a preferred safety rail system of the present invention generally comprises a plurality of stanchion-supporting bases for attachment to existing building structure, a plurality of stanchions removably held by the bases and having cable-receiving links thereon, and a pair of wire rope cable safety rails supplied by a pair of winches fixed to at least one of the stanchions. The bases include a pair of plate members connected by hinge means for adjustable attachment to a vertical wall surface of the building and another structural surface forming an edge with the vertical wall surface. A vertically extending sleeve is fixed to the plate member which attaches to the vertical wall surface of the building for slidably receiving a bottom portion of a stanchion, and a transversely extending locking pin is used to retain the bottom portion of the stanchion within the sleeve. The other plate member carries a worker safety line link. The safety rail cables are unwound from their respective winches and connected to the stanchions using the cable receiving links, then tensioned using the winches.

BRIEF DESCRIPTION OF THE DRAWINGS

The nature and mode of operation of the present invention will now be more fully described in the following detailed description of the preferred embodiments taken with the accompanying drawing figures, in which:

FIG. 7 is a perspective view showing a support apparatus of the preferred embodiment which includes means for tensioning upper and lower cable rails supported thereby;

FIGS. 8 and 9 are side elevational views showing an adjustable pitch base of the preferred apparatus; and FIG. 10 is a side elevational view showing a simplified non-adjustable base according to an alternative embodiment of the present invention.

DETAILED DESCRIPTION OF THE PREFERRED EMBODIMENTS

Figure 1:
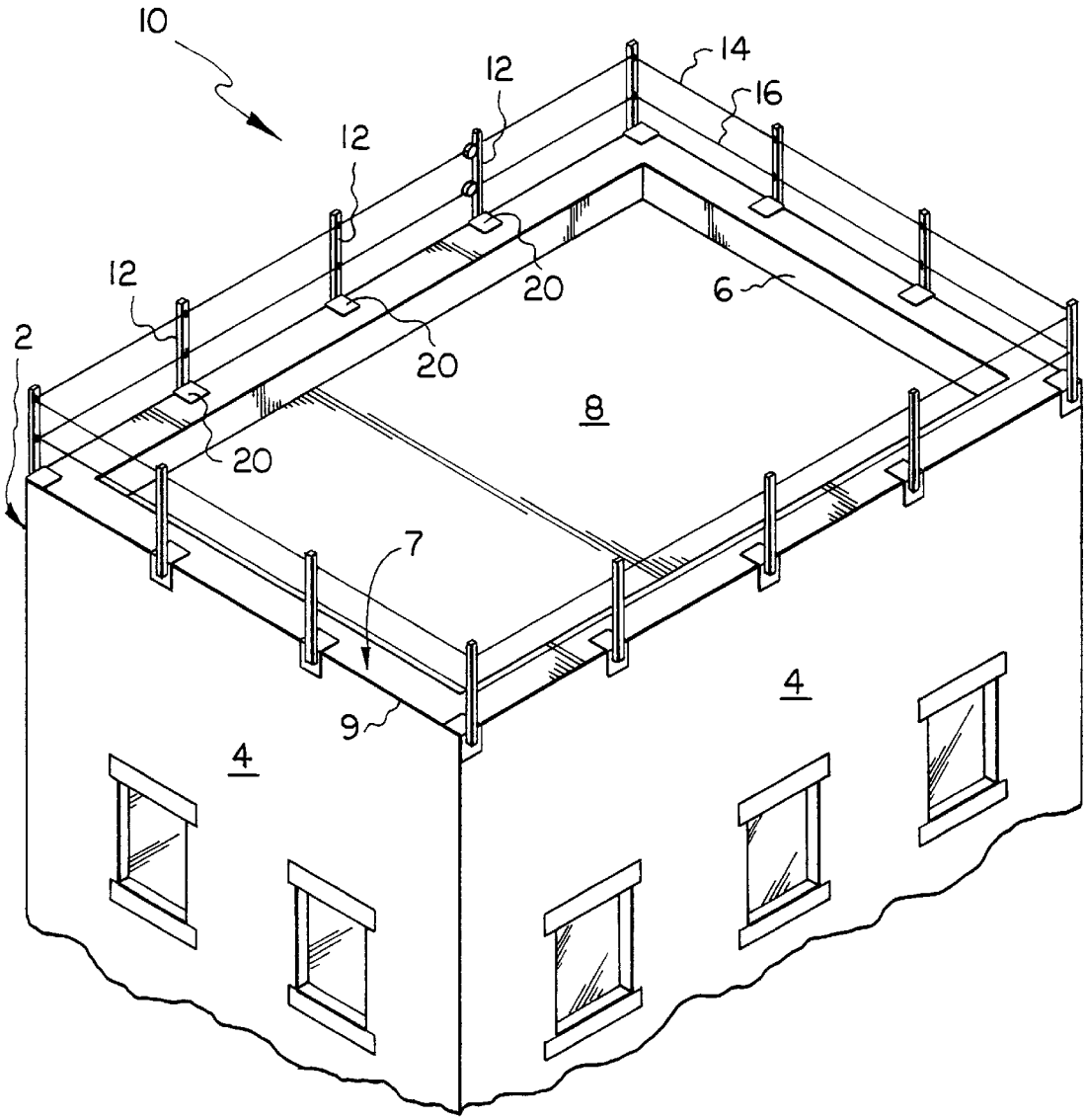
FIG. 1 is a perspective view showing a safety rail system of the present invention installed about the perimeter of a roof.

Referring initially to FIG. 1 of the drawings, a roof perimeter safety rail system formed in accordance with a preferred embodiment of the present invention is designated generally by the reference numeral 10, and is shown installed about the perimeter of a roof 8 of a building 2 having structural walls 4 and a parapet 6. Safety rail system 10 comprises a plurality stanchions 12 removably mounted about the roof perimeter at spaced intervals preferably no greater than eight feet in length, as dictated by government safety standards, for supporting an upper safety rail 14 and a lower safety rail 16.

Figure 2:
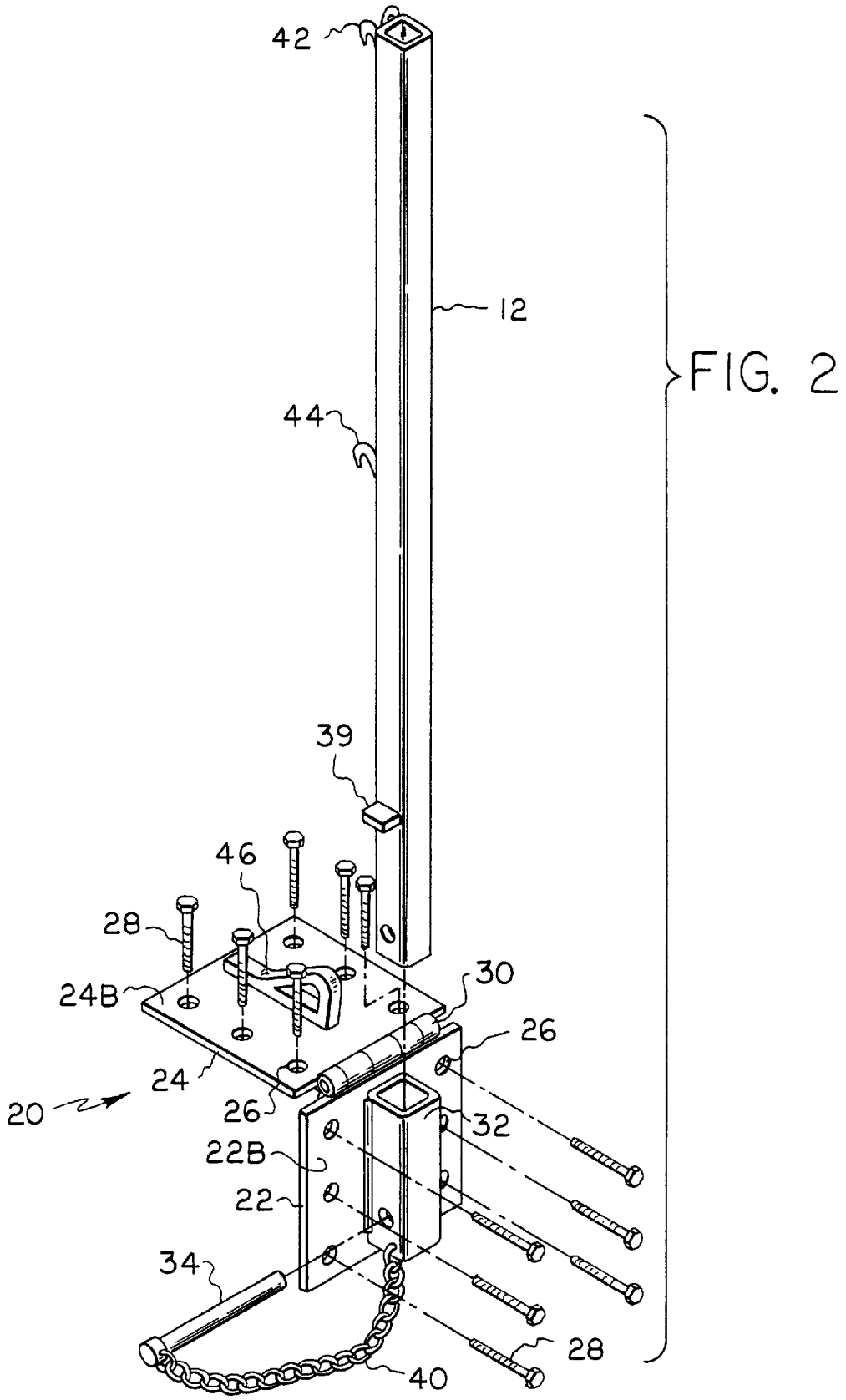
FIG. 2 is an exploded view showing an apparatus formed in accordance with a preferred embodiment of the present invention for supporting the safety rail of FIG. 1.

FIG. 2 shows a preferred rail-supporting stanchion apparatus of the present invention in detail. The apparatus includes a base 20 designed for removable attachment to a pair of existing structural surfaces of building 2, namely to a vertical surface of structural wall 4 and to an upwardly facing surface 7 of parapet 6 joined with the vertical wall surface along a common edge 9. More specifically, base 20 includes a first rectangular plate member 22 defining a first contact surface 22A, best seen in FIGS. 8 and 9, for surface-to-surface engagement with the vertical surface of structural wall 4, and base 20 further includes a second rectangular plate member 24 defining a second contact surface 24A, also best seen in FIGS. 8 and 9, for surface-to-surface engagement with the top surface 7 of parapet 6. First and second plate members 22 and 24 are each provided with a plurality of through-holes 26 for receiving fasteners 28 chosen for the structural building material to which the plate members must be attached.

In the preferred embodiment, plate members 22 and 24 are joined along matched edges thereof by hinge means 30 for enabling continuous adjustment of the angular orientation between first and second contact surfaces 22A and 24A. Accordingly, base 20 may be mounted at the perimeter of a roof wherein the wall surface and adjacent upwardly facing surface are not at a ninety degree angle relative to each other, such as where the upwardly facing surface is a roof surface at a predetermined pitch. In an alternative embodiment of the present invention, shown in FIG. 10, base 20 is of a one-piece construction which does not permit adjustment of the angular orientation between first and second contact surfaces 22A and 24A. While FIG. 10 depicts a one-piece non-adjustable base formed of ninety-degree angle stock, other non-adjustable angles are of course possible for accommodating common roof pitches.

Figure 3:
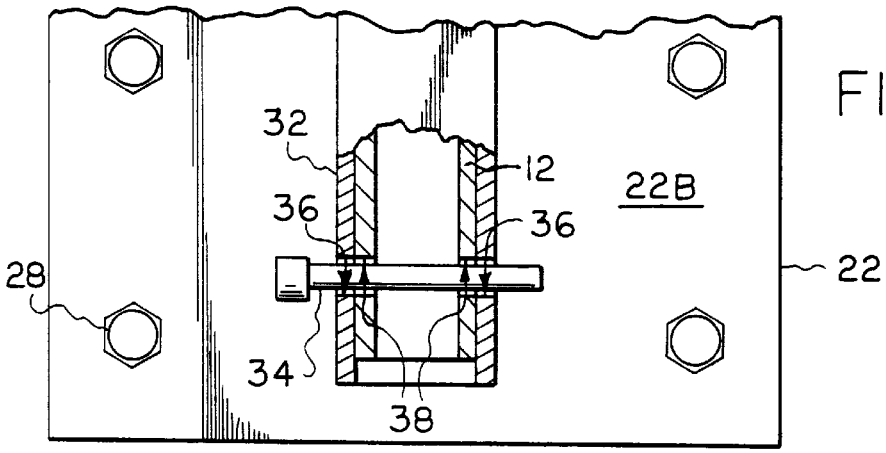
FIG. 3 is an elevational view, partially sectioned, showing stanchion retaining means of the present invention.

An elongated sleeve 32 sized for slidably receiving a bottom portion of stanchion 12 is fixed, such as by welding, to an outer surface 22B of first plate member 22 such that a longitudinal axis of the sleeve extends in a generally vertical direction when first plate member 22 is attached to a structural wall 4. As may be seen in FIG. 3, the bottom portion of stanchion 12 is retained within sleeve 32 by a transversely extending locking pin 34 received within aligned holes 36 and 38 in sleeve 32 and stanchion 12, respectively. Locking pin 34 is preferably tethered to base 20 by a flexible cord or chain 40 to keep the locking pin in close proximity to sleeve 32 during installation and removal of the present apparatus.

Stanchion 12 and sleeve 32 are preferably formed of rectangular tube stock providing flat surfaces which prevent rotation of the stanchion when the bottom portion of the stanchion is received within the sleeve. A stop member 39 is fixed to stanchion 12 for limiting insertion of the bottom portion of the stanchion within sleeve 32 to quickly align holes 36 and 38. Stanchion 12 is at least forty inches in height as measured from roof edge 9 to meet government regulations. An inwardly facing flat surface 12A of stanchion 12 carries upper and lower cable-receiving links 42 and 44 fixed thereto for supportively connecting upper and lower safety rails 14 and 16 to the stanchion. In the preferred embodiment, safety rails 14 and 16 are simply wire rope cables which may be spooled for easy transport and installed quickly as described below. Standard cable lengths of fifty or one-hundred feet having looped ends for connection to a link 42 or 44 are particularly suitable for use in safety rail system 10.

At least one of the plurality of stanchions 12 in safety rail system 10 is specially equipped with a pair of vertically spaced winches 48 and 50 mounted on a side surface 12C of the stanchion for spooling and tensioning cable rails 14 and 16, respectively.

A safety line link 46 is preferably fixed to an outer surface 24B of second plate member 24, which link may be used by a worker installing safety rail system 10 as described below.

The system of the present invention is designed for easy installation at, and removal from, a rooftop work site. As will be appreciated from the coming description, installation may be accomplished by a single worker, if necessary. The first step in the installation procedure is to locate a plurality bases 20 at spaced intervals up to eight feet long about the roof perimeter and removably attach each base 20 to existing building structure using suitable fasteners 28. The first plate member 22 of each base is set with corresponding first contact surface 22A flush against a structural wall 4, and the second plate member 24 of each base is set with corresponding second contact surface 24A flush against an upwardly facing structural surface 7. As will be evident from FIGS. 8 and 9, upwardly facing structural surface 7 may be horizontal or sloped, requiring hinged adjustment of the angle between first and second plate members 22 and 24. A major advantage of the preferred embodiment is that each base 20 may be attached to existing building structure prior to insertion of stanchions 12 within sleeves 32, thereby minimizing weight and bulk so that a single worker may install bases 20 without assistance from a second worker. Also, once the first base 20 is securely attached to the building structure, a worker installing the next base can connect a safety harness line to safety line link 46 on the previously installed base, and so on until all the bases 20 are installed about the roof perimeter.

The next step is to install stanchions 12 by sliding a bottom portion of each stanchion into an associated sleeve 32 until stanchion holes are aligned with sleeve holes 36, being sure to orientate the stanchion such that rail links 42 and 44 are facing inward toward roof 8, and then inserting locking pin 34 within the aligned holes.

Figure 5:
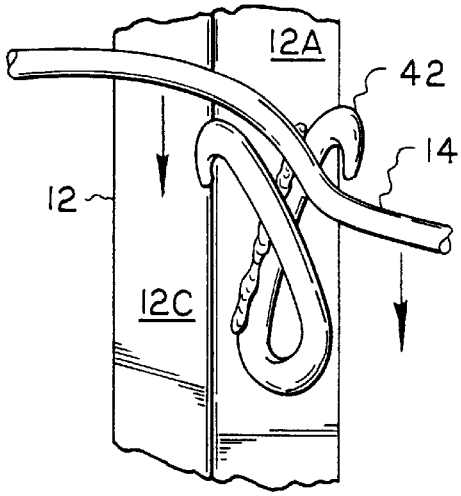
FIGS. 5 and 6 are similar perspective views illustrating connection of a cable rail to the stanchion using the cable-receiving link shown in FIG. 4.
Figure 4:
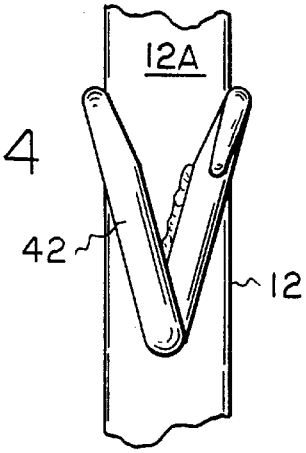
FIG. 4 is an elevational view showing a cable-receiving link for supportively connecting a cable rail to the stanchion.
Figure 6:
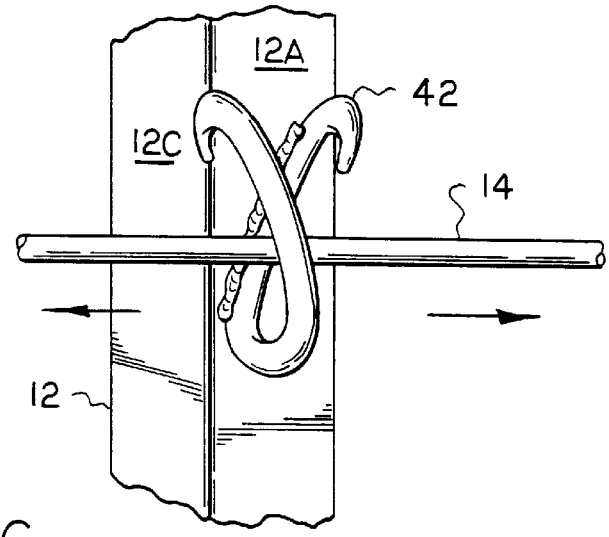

Once all the stanchions 12 are installed, the upper and lower safety rails 14 and 16 must be connected to the stanchions to extend completely about the perimeter of roof 8. As mentioned above, standard lengths of wire rope cable may be used as safety rails. Upper safety rail 14 is unwound from upper winch 48 and inserted within upper cable-receiving links 42 on stanchions 12, as illustrated in FIG. 5, until it is completely unwound, at which point the distal end of the cable rail, which preferably includes an eye loop, is connected to the last link 42 which it reaches. Cable safety rail 14 is then tensioned, as illustrated in FIG. 6, using winch 48. Connection of lower safety rail 16 is carried out in a similar manner using winch 50 and cable-receiving links 44. Of course, if the safety rail cables do not reach completely around the roof perimeter for connection of the distal ends to the original stanchion having winches 48 and 50, then more than one winch-equipped stanchion must be used to supply cable.

It is intended that safety rail system 10 of the present invention be fabricated from suitable materials and installed in a manner which assures that it can withstand at least two-hundred pounds of force to prevent an accidental fall. The presently indicated materials for constructing bases 20 and stanchions 12 are steel and aluminum, with aluminum providing the advantage of a lighter weight construction.

As will be readily appreciated from the foregoing description, the safety rail system of the present invention offers ease of installation for a variety roof pitches without requiring more than one worker to perform the set up. Moreover, the system of the present invention offers compact storage and more manageable transport to a rooftop work site due to the use of spoolable wire rope cables as safety rails 14 and 16, and the separability of stanchions 12 from bases 20. An important safety advantage is also realized in that the safety rails 14 and 16 may simply be retracted from one stanchion to an adjacent stanchion using winches 48 and 50 to provide an access opening for materials, equipment, and workers to reach the rooftop, thus eliminating the potentially dangerous practice of placing rail members on the roof where workers may trip over them, as is sometimes done with board type rail members of prior art systems.

What is claimed is:

1. An apparatus for supporting safety rails about the perimeter of a roof, said apparatus comprising:

a base having adjacent first and second flat plate members adapted to be attached to adjacent sides of an edge of the roof and a hinge connecting adjacent parallel edges of said first and second plate members for continuous pivotal adjustment of said first and second plate members, each of said first and second plate members having a respective plurality of fastener-receiving through-holes;

a sleeve fixed to said first plate member, said sleeve having a longitudinal axis parallel to said first plate member;

a stanchion having a bottom portion slidably received by said sleeve, said stanchion including means for supportively connecting a pair of spaced safety rails to said stanchion; and retaining means for releasably securing said bottom portion of said stanchion within said sleeve.

2. The apparatus according to claim 1, further comprising hook means fastened to said second plate member for securing a worker safety line thereto.

3. The apparatus according to claim 1, wherein said retaining means comprises a transversely extending locking pin received within aligned holes in said sleeve and said stanchion.

4. The apparatus according to claim 1, wherein said means for supportively connecting said pair of safety rails includes upper and lower cable-receiving links fixed to said stanchion.

5. The apparatus according to claim 4, wherein said stanchion further includes a pair of winches connected thereto for spooling and tensioning said pair of safety rails.

* * * * *